US005341565A

United States Patent [19]

Kuryliw

[11] Patent Number: 5,341,565

[45] Date of Patent: Aug. 30, 1994

[54] METHOD OF SECURING A FILTER ELEMENT TO A BLADE OF A FAN

[76] Inventor: William Kuryliw, Box 1434, Lac La Biche, Alberta, Canada, T0A 2C0

[21] Appl. No.: 76,748

[22] Filed: Jun. 15, 1993

[51] Int. Cl.[5] ..... B23D 15/00

[52] U.S. Cl. ..... 29/889.721; 29/889.72; 416/5; 416/91

[58] Field of Search ..... 29/889.7, 889.72, 889.721, 29/428; 55/467; 416/5, 91

[56] References Cited

U.S. PATENT DOCUMENTS

| | | | |
|---|---|---|---|
| 411,826 | 10/1889 | Murray . | |
| 1,184,287 | 1/1924 | Weiss | 312/108 |
| 1,311,811 | 7/1919 | Gough . | |
| 1,604,877 | 10/1926 | Burckhalter . | |
| 1,684,145 | 9/1928 | Riek | 29/462 X |
| 1,833,674 | 11/1931 | Fedeler . | |
| 2,197,120 | 4/1940 | Bergmann | 183/77 |
| 2,354,817 | 8/1944 | Law | 250/43 |
| 3,422,263 | 1/1969 | Asahina | 250/44 |
| 3,816,981 | 6/1974 | Carnewal | 55/267 |
| 3,846,072 | 11/1974 | Patterson | 21/74 |
| 4,292,055 | 9/1981 | De Castella et al. | 55/233 |
| 4,422,824 | 12/1983 | Eisenhardt, Jr. | 416/5 |
| 4,676,721 | 6/1987 | Hardee | 416/5 |
| 4,753,573 | 6/1988 | McKnight | 416/62 |
| 4,782,213 | 11/1988 | Teal | 416/5 |
| 4,840,650 | 6/1989 | Matherne | 55/385.1 |
| 4,889,543 | 12/1989 | Burt | 55/97 |
| 5,082,422 | 1/1992 | Wang | 416/5 |

FOREIGN PATENT DOCUMENTS

| | | | |
|---|---|---|---|
| 3505823 | 8/1986 | Fed. Rep. of Germany | 416/91 |
| 557530 | 5/1923 | France | 416/91 |
| 592393 | 8/1925 | France | 416/91 |
| 1057408 | 3/1954 | France | 15/4 |
| 1199701 | 12/1959 | France | 312/108 |
| 1226197 | 10/1960 | France | 423/108 |
| 361931 | 8/1938 | Italy | 416/5 |
| 385772 | 1/1933 | United Kingdom . | |
| 497048 | 12/1938 | United Kingdom | 416/91 |
| 901820 | 7/1962 | United Kingdom | 416/91 |
| 1265761 | 3/1972 | United Kingdom | F04D 29/32 |
| 2100116 | 12/1982 | United Kingdom | 312/108 |

*Primary Examiner*—Irene Cuda
*Attorney, Agent, or Firm*—Anthony R. Lambert

[57] ABSTRACT

A method of securing a filter element to a blade of a fan includes firstly, forming a cavity within a fan blade so that the cavity has a tip end oriented toward a tip of the fan blade and a root end oriented toward a root of the fan blade. Secondly, form at least one flow passage extending from one broad surface of a fan blade through the cavity to an opposed broad surface of the fan blade, such that air circulates through the cavity via the flow passages upon movement of the fan blade. Thirdly, form an access opening through which a filter element is inserted into the cavity.

6 Claims, 2 Drawing Sheets

METHOD OF SECURING A FILTER ELEMENT TO A BLADE OF A FAN

The present invention relates to a method of securing a filter element to a blade of a fan.

BACKGROUND OF THE INVENTION

Fans are employed in many homes to serve the function of moving stagnant air. The concept of securing a filter element to a blade of the fan in order to filter air thereby trapping air borne particles as the fan blade moves is taught in a number of references.

U.S. Pat. No. 4,753,573 which issued to McKnight in 1988 discloses a longitudinally extending channel member that is fixed by adhesive to a fan blade such that a filter element is supported in an upstanding position extending outwardly from the fan blade.

U.S. Pat. No. 4,840,650 which issued to Matherne in 1989 discloses a filter housing having clips which attach the filter housing to a leading edge of a fan blade.

U.S. Pat. No. 4,889,543 which issued to Burt in 1989 discloses a method and apparatus in which filter elements extend between adjacent circumferentially spaced apart fan blades.

It is readily apparent to an observer when a fan is equipped with one of the described devices. Some types of fans, for example ceiling fans serve a collateral decorative purpose. Great care is taken to make ceiling fans, aesthetically appealing to the consumer. Anything which potentially detracts from the aesthetic appearance of the fan is viewed as being undesirable.

SUMMARY OF THE INVENTION

What is required is a method of securing a filter element to a blade of a fan that is relatively unobtrusive.

According to one aspect of the present invention there is provided a method of securing a filter element to a blade of a fan which includes the following described steps. Firstly, form a cavity within a fan blade. The cavity has a tip end oriented toward a tip of the fan blade and a root end oriented toward a root of the fan blade. Secondly, form at least one flow passage extending from one broad surface of a fan blade through the cavity to an opposed broad surface of the fan blade, such that air circulates through the cavity via the flow passages upon movement of the fan blade. Thirdly, form an access opening through which a filter element is inserted into the cavity.

With the method, as described, the filter element is hidden within the fan blade. The flow passages can be attractively arranged to be aesthetically pleasing and in no way detract from the fan's role as a decorative piece. Although beneficial results may be obtained through the method, as described, depending upon the positioning of the access opening there may be a tendency for the filter element to be urged back through the access opening by centrifugal force. Even more beneficial results may, therefore, be obtained by providing means to prevent the filter element from being propelled back through the access opening by centrifugal force.

In order to address this problem, it is preferred that the access opening be a channel extending at an angle through one of the broad surfaces of the fan blade adjacent one of the tip end and the root end. The greater the angle of the access channel the less likely centrifugal force will be able to dislodge the filter element. It is preferred that the access channel being at an angle of between 5 degrees and 35 degrees.

Although beneficial results may be obtained through the use of the method, as described, the Applicant has devised a simple and cost effective manner to maintain the filter element in position that can withstand and even benefit from centrifugal force. Even more beneficial results may be obtained by placing the access channel adjacent to and spaced inwardly from the tip end while being angled toward the root end. Upon rotation of the fan blade the filter element is propelled by centrifugal force past the access channel until the filter element engages the tip end thereby maintaining the filter element within the cavity.

According to another aspect of the invention there is provided a blade for a fan which includes a blade body having a tip, a root and opposed broad surfaces. A cavity is provided within the body. The cavity has a tip end oriented toward the tip of the body and a root end oriented toward the root of the body. At least one flow passage extends from one broad surface of the body through the cavity to the opposed broad surface of the body, such that air circulates through the cavity via the flow passages upon movement of the body. An access channel to the cavity extends through one of the broad surfaces of the body adjacent to and spaced inwardly from the tip end while being angled toward the root end. Upon rotation of the body the filter element is propelled by centrifugal force past the access channel until the filter element engages the tip end thereby maintaining the filter element within the cavity.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
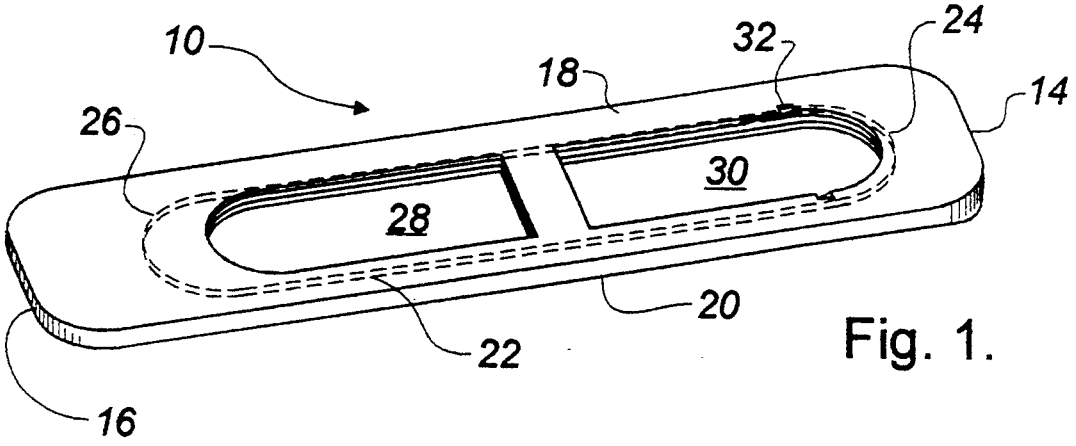
FIG. 1 is a perspective view of a fan blade constructed in accordance with the teachings of the present invention.

The method of securing a filter element to a blade of a fan, includes the following steps. Firstly, form a cavity within a fan blade. The cavity having a tip end oriented toward a tip of the fan blade and a root end oriented toward a root of the fan blade. Secondly, form at least one flow passage extending from one broad surface of a fan blade through the cavity to an opposed broad surface of the fan blade, such that air circulates through the cavity via the at least one flow passage upon movement of the fan blade. Thirdly, forming an access opening through which a filter element is inserted into the cavity. In order to successfully follow the teachings of the described method, some means must be employed to prevent centrifugal force exerted upon rotation of the fan blades from dislodging the filter element. The preferred embodiment which discloses the best mode for putting the method into practise will now be described.

The preferred embodiment, a blade for a fan generally identified by reference numeral 10, will now be described with reference to FIGS. 1 through 4.

Blade 10 includes a blade body 12 having a tip 14, a root 16 and opposed upper broad surface 18 and lower broad surface 20. A cavity 22 is provided within body 12. Cavity 22 has a tip end 24 oriented toward tip 14 of body 12 and a root end 26 oriented toward root 16 of body 12. A plurality of flow passages 28 and 30 extend from upper broad surface 18 of body 12 through cavity 22 to lower broad surface 20 of body 12. Air circulates through cavity 22 via flow passages 28 and 30 upon movement of body 12. A channel form access opening, hereinafter referred to as access channel 32 communicates with cavity 22. Access channel 32 extends through upper broad surface 18 of body 12. Access channel 32 is positioned adjacent to and spaced inwardly from tip end 24. Access channel 32 is angled toward root end 26. The degree of angle should be sufficient to impede a filter element 34 from being withdrawn from cavity 22 via access channel 32, and not so severe that filter element 34 will be difficult to insert or become damaged during the process of insertion. An operative range has been found to be between 5 and 35 degrees.

Figure 2:
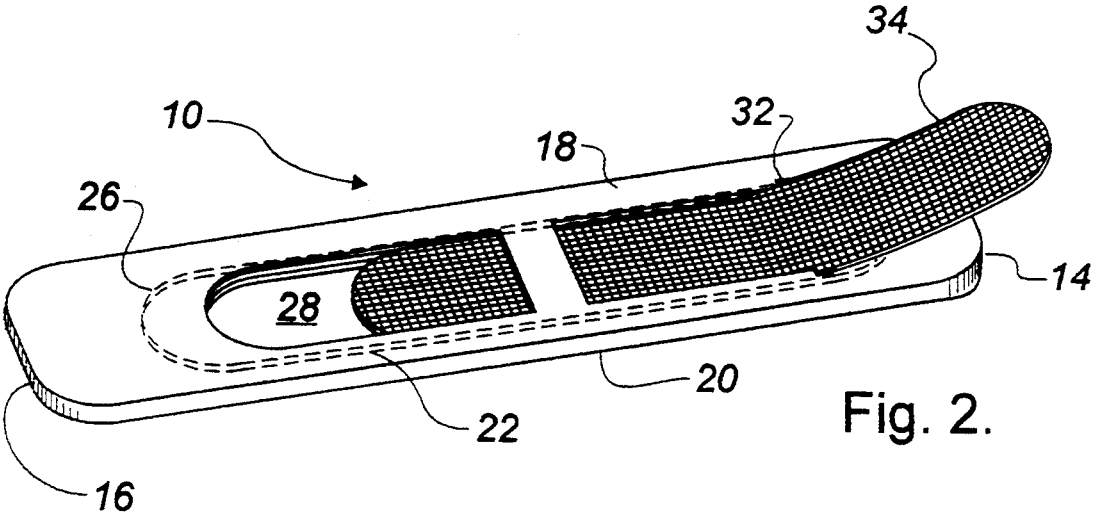
FIG. 2 is a perspective view of the fan blade illustrated in FIG. 1 with a filter element in the process of being inserted.
Figure 3:
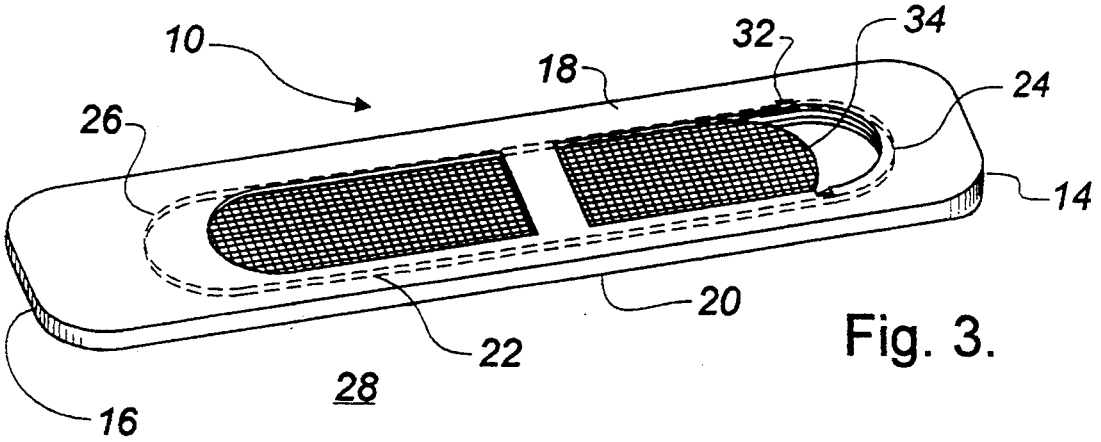
FIG. 3 is a perspective view of the fan blade illustrated in FIG. 1 with the filter element inserted.
Figure 4:
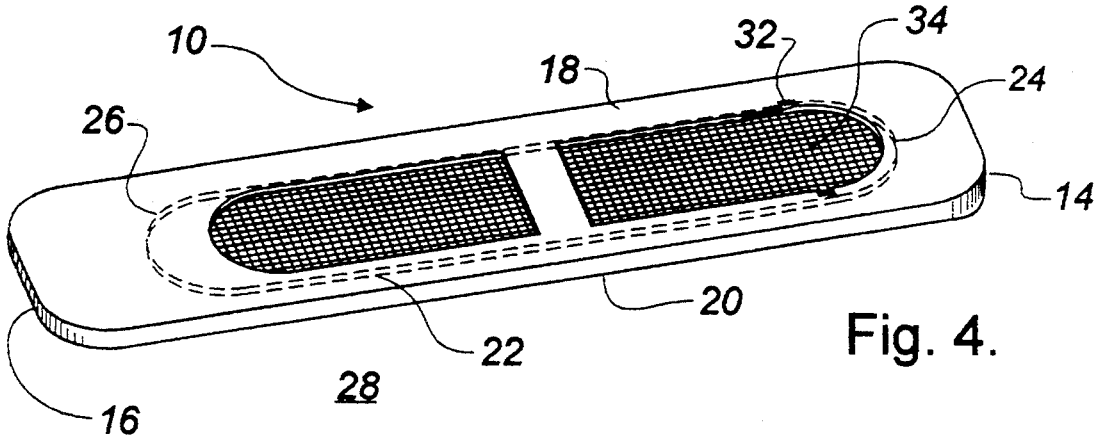
FIG. 4 is a perspective view of the fan blade illustrated in FIG. 1 with the filter element in an operative position.

The use and operation of fan blade 10 will now be described with reference to FIGS. 1 through 4. FIG. 1 illustrates fan blade 10 with filter element 34 removed. Referring to FIG. 2, filter element 34 is inserted through access channel 32. Filter element 34 is slid along toward root end 26 of cavity 22 until it has completely passed through access opening to assume the position illustrated in FIG. 3. Filter element 34 is then slid toward tip end 24 and passed access opening 32 until filter element is in an operative position illustrated in FIG. 4. It should be noted that upon rotation of body 12, filter element 34 is urged by centrifugal force toward tip end 24 of cavity 22. Filter element 34 engages tip end 24 and is thereby maintained within cavity 22. Once the end of filter element 34 has passed access channel 32 toward tip end 24, it is virtually impossible for filter element 34 to be dislodged by centrifugal force. Centrifugal force will, in fact, more securely urge filter element 34 into position. In order to remove filter element 34, filter element 34 is drawn back from tip end 24 and is threaded back through access opening 32.

It will be apparent to one skilled in the art that modifications may be made to the illustrated embodiment without departing from the spirit and scope of the invention as defined by the claims.

The embodiments of the invention in which an exclusive property or privilege is claimed are defined as follows:

1. A method of securing a filter element to a blade of a fan, comprising the steps of:

a) firstly, forming a cavity within a fan blade, the cavity having a tip end oriented toward a tip of the fan blade and a root end oriented toward a root of the fan blade;

b) secondly, forming at least one flow passage extending from one broad surface of the fan blade through the cavity to an opposed broad surface of the fan blade, such that air circulates through the cavity via the at least one flow passage upon movement of the fan blade; and c) thirdly, forming an access opening into the cavity;

d) fourthly, inserting a filter element through the access opening into the cavity.

2. The method as defined in claim 1, means being provided to prevent the filter element from being propelled back through the access opening by centrifugal force.

3. The method as defined in claim 1, the access opening being a channel extending at an angle through one of the broad surfaces of the fan blade adjacent one of the tip end and the root end.

4. The method as defined in claim 2, the access channel being at an angle of between 5 degrees and 35 degrees.

5. The method as defined in claim 2, the access channel being adjacent to and spaced inwardly from the tip end while being angled toward the root end, such that upon rotation of the fan blade the filter element is propelled by centrifugal force past the access channel until the filter element engages the tip end thereby maintaining the filter element within the cavity.

6. A method of securing a filter element to a blade of a fan, comprising the steps of:

a) forming a cavity within a fan blade, the cavity having a tip end oriented toward a tip of the fan blade and a root end oriented toward a root of the fan blade;

b) forming flow passages extending from one broad surface of the fan blade through the cavity to an opposed broad surface of the fan blade, such that air circulates through the cavity via the flow passages upon movement of the fan blade;

c) forming an access channel through one of the broad surfaces of the fan blade adjacent to and spaced inwardly from the tip end while being angled between 5 and 35 degrees toward the root end; and d) inserting a filter element through the access opening into the cavity, such that upon rotation of the fan blade the filter element is propelled by centrifugal force past the access channel until the filter element engages the tip end thereby maintaining the filter element within the cavity.

* * * * *